United States Patent [19]

Kagami et al.

[11] Patent Number: 4,725,534

[45] Date of Patent: Feb. 16, 1988

[54] PROCESS FOR PRODUCING A HEAT-DEVELOPABLE PHOTOSENSITIVE MATERIAL

[75] Inventors: Kenji Kagami, Higashikurume; Kenichi Nishio, Sagamihara; Yukio Takegawa, Hino; Kazunori Shigemori, Tokyo, all of Japan

[73] Assignee: Oriental Photo Industrial Co., Ltd., Tokyo, Japan

[21] Appl. No.: 706,232

[22] Filed: Feb. 26, 1985

Related U.S. Application Data

[63] Continuation of Ser. No. 438,548, Nov. 1, 1982, abandoned.

[51] Int. Cl.[4] ..... G03C 1/02

[52] U.S. Cl. ..... 430/619; 430/620; 430/617; 430/353; 430/567; 430/569

[58] Field of Search ..... 430/619, 620, 569, 567, 430/353, 617

[56] References Cited

U.S. PATENT DOCUMENTS

| | | | |
|---|---|---|---|
| 3,457,075 | 7/1969 | Morgan et al. | 430/619 |
| 3,589,903 | 6/1971 | Birkeland | 430/619 |
| 3,764,329 | 10/1973 | Lee | 430/353 |
| 3,871,887 | 3/1975 | Jones | 430/619 |
| 4,120,728 | 10/1978 | Ikenoue et al. | 430/618 |
| 4,152,160 | 5/1979 | Ikienoue et al. | 430/620 |
| 4,157,289 | 6/1979 | Ikenoue et al. | 430/564 |
| 4,193,804 | 3/1980 | Ikenoue et al. | 430/620 |
| 4,211,839 | 7/1980 | Suzuki et al. | 430/619 |
| 4,237,215 | 12/1980 | Ikenoue et al. | 430/620 |
| 4,267,267 | 5/1981 | Ikenoue et al. | 430/620 |
| 4,435,499 | 3/1984 | Reeves | 430/620 |

OTHER PUBLICATIONS

Morgan, *3M's Dry Silver Technology*, Sep. 5, 1980, pp. 1–8.

*The Morphology and Structure of Silver Laurate*, Photo. Sci. Eng., 24, No. 6 (1980).

*The Theory of the Photographic Process*, 4th edition, pp. 149 to 160.

*Primary Examiner*—Won H. Louie

*Attorney, Agent, or Firm*—Flynn, Thiel, Boutell & Tanis

[57] ABSTRACT

A process for producing a heat-developable photosensitive material containing fine photosensitive silver halide particles having a uniform particle form and particle size, said silver halide being prepared by reacting a silver salt of an organic fatty acid stoichiometrically with an inorganic or organic halogen compound.

21 Claims, 1 Drawing Figure

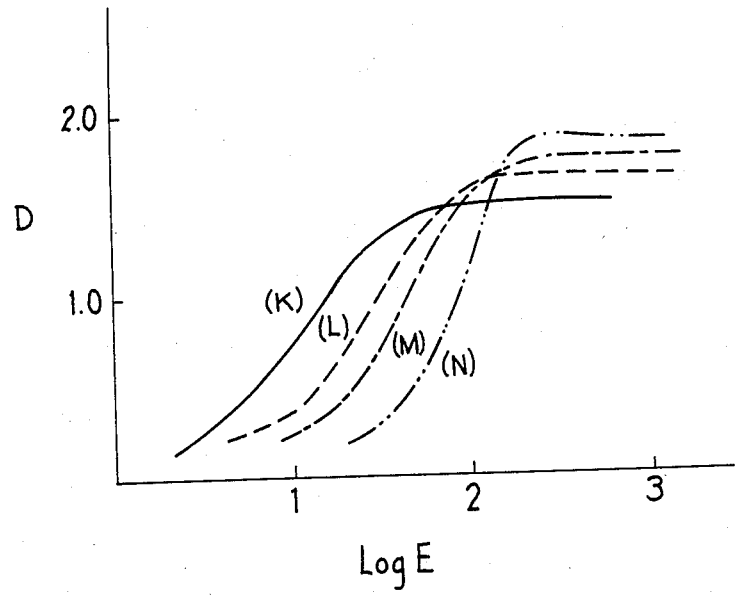
2.0
D
1.0
(K)
(L)
(M)
(N)
1
2
3
Log E

PROCESS FOR PRODUCING A HEAT-DEVELOPABLE PHOTOSENSITIVE MATERIAL

This application is a continuation of U.S. Ser. No. 438,548 filed Nov. 1, 1982, abandoned.

The present invention relates to a process for producing a highly sensitive, heat-developable photosensitive material containing a particulate silver halide as a photosensitive catalyst. More particularly, the invention relates to a process for producing a heat-developable photosensitive material containing fine silver halide particles. having a uniform particle size as a photosensitive catalyst which is stable in an organic solvent.

As compared with a photographic method in which a silver salt-free photosensitive material is used, such as diazo photography or electrophotography, silver halide photography now employed broadly is a more excellent method with respect to photosensitivity and gradation. However, this method has problems in that a silver halide photographic material used in this method requires a wet treatment step so as to obtain a stable image and, therefore, it is time-consuming and laborious, and that chemicals used in this process are harmful to the human body. Under these circumstances, the development of a photographic method capable of forming a stable image by dry treatment with a silver halide has been demanded eagerly. Various studies have been made on this technique.

For example, the most successful, heat-developable photosensitive material disclosed in the specification of U.S. Pat. No. 3,152,904 or 3,457,075 comprises three components, i.e. a reducible organic silver salt, reducing agent and photosensitive silver halide catalytically contacted with the organic silver salt. In case such a heat-developable photosensitive material is used, an image is formed by heating to at least 80° C., preferably at least 100° C., after the exposure. The heat-developable photosensitive material does not necessitate a special stabilization treatment after image formation, since it contains only a small amount of a photosensitive silver halide which is unstable to light. Accordingly, if the heat-developable photosensitive material is used, a stable high-quality image can be obtained without resort to a wet process at all.

The photosensitive silver halide in the heat-developable photosensitive material is an important factor for the photographic characteristics of the heat-developable photosensitive material. It has been said that fine particles of silver chloride, silver bromide, silver bromochloride and silver iodobromide are particularly preferred. As processes for producing the silver halides, there may be mentioned a process wherein a silver halide is prepared in situ, such as (1) a process of U.S. Pat. No. 3,457,075 wherein part of a reducible organic silver salt is converted into silver halide with ammonium bromide or sodium chloride and (2) a process of British Pat. No. 1,498,956 wherein an N-halogenated compound is heat-decomposed to convert part of a reducible organic silver salt into a photosensitive silver halide. In process (1), a part of a reducible organic silver salt is halogenated to form a photosensitive silver halide. At that time, a disadvantageous effect on the balance (major part) of the reducible organic silver salt should be avoided. The formation of the photosensitive silver halide and its sensitization must be effected under limited conditions. Therefore, it is difficult to directly employ a sensitization method generally employed in a wet silver halide photographic emulsion system, particularly the one employing a chemical sensitizer or the one wherein the particle size of photosensitive silver halide is controlled.

For these reasons, the process (2), i.e., a so-called out-of-site silver halide production process, is recommended. The silver halide-containing photosensitive composition is prepared by previously forming a photosensitive silver halide at another place and mixing the same with a reducible organic silver salt. However, it is apparent from the specifications of U.S. Pat. Nos. 3,152,904 and 3,457,075 that a photosensitive silver halide prepared by conventional silver halide photographic emulsion process is not preferred. A reason therefor is that in the photographic emulsion containing gelatin as a protective colloid, the photosensitive silver halide cannot be in full contact with the reducible organic silver salt ( an image-forming component), since adsorption between the silver halide and gelatin is strong.

A silver halide prepared in the absence of a protective colloid such as gelatin is unsuitable for use as a sensitizer of a heat-developable photosensitive material, since aggregation of silver halide particles occurs.

Various attempts have been made for the purpose of producing a photosensitive silver halide which can be contacted effectively with a reducible organic silver salt. For example, in the specification of British Pat. No. 1,362,970, there is disclosed a process wherein an organic solvent containing an oil-soluble binder is emulsified with an aqueous solution of an inorganic silver compound by ultrasonic dispersion and a solution of an inorganic halogen compound in an organic solvent is added to the resulting emulsion to form a photosensitive silver halide in the oilsoluble binder. However, a photosensitive silver halide having a uniform particle form and particle size cannot be obtained by this process. In addition, complicated operations are required for the ultrasonic dispersion and decantation for removing the aqueous phase. In the specifications of U.S. Pat. Nos. 3,713,833 and 3,871,887, there is disclosed a process wherein an inorganic silver compound soluble in a polar organic solvent such as acetone is reacted with an inorganic halogen compound in an oil-soluble binder to form a photosensitive silver halide. However, products having uniform particle form and particle size cannot be obtained by this process. In addition, aggregation of the particles occurs easily in this process. In the specifications of U.S. Pat. Nos. 4,120,728 and 4,161,408, there is disclosed a process wherein a photosensitive silver halide is formed in an aqueous or water/organic solvent emulsion and then a reducible organic silver salt is formed in the presence of the resulting photosensitive silver halide.

However, in this process, properties of the photosensitive silver halide realized by various sensitizing treatments before it is mixed with the reducible organic silver salt cannot be maintained, since the photosensitive silver halide formed is exposed to chemically active environments or a high-temperature atmosphere. The specifications of U.S. Pat. Nos. 3,706,565 and 3,706,564 disclose the formation of a photosensitive silver halide in the presence of an amphiphilic copolymer and the specification of U.S. Pat. No. 4,076,539 discloses the formation of the same in the presence of a surfactant. However, in these processes, troublesome operations are necessitated and production of a silver halide having a uniform particle size is difficult.

Therefore, the first object of the present invention is to provide a heat-developable photosensitive material which realizes a high image density and a high contrast. The second object of the invention is to provide a heat-developable photosensitive material containing particulate photosensitive silver halide produced easily and stably in an organic solvent. The third object of the invention is to provide a heat-developable photosensitive material containing a photosensitive silver halide having a controlled particle size which has been produced in an organic solvent. The fourth object of the present invention is to provide a heat-developable photosensitive material containing a photosensitive silver halide which can be used without resort to the steps of washing and removal of by-products. The fifth object of the invention is to provide a heat-developable photosensitive material containing a chemically sensitized silver halide.

After intensive investigations made for the purpose of attaining these objects, the inventors have reached a conclusion that the production of a particulate photosensitive silver halide having a uniform particle shape and particle size from a silver ion source dissolved in an organic solvent is difficult according to a conventional wet silver halide formation technique.

The inventors have found that if an inorganic or organic halogen compound is added to a suspension or dispersion of a silver salt of an organic fatty acid in an organic solvent used as a silver ion source, a photosensitive silver halide is formed substantially stoichiometrically and, that the resulting photosensitive silver halide is in the form of a fine particle having a uniform particle form and particle size and stable in an organic solvent. (The term "stoichiometrically" means that 1 mol of photosensitive silver halide is formed from 1 mol of a silver ion source and 1 mol of a halogen ion source). The inventors have found also that a heat-developable photosensitive material containing the formed silver halide as a photosensitive catalyst has excellent photographic properties such as sensitivity, image density and gradation. The present invention has been attained on the basis of these findings.

BRIEF DESCRIPTION OF THE DRAWING:

The drawing Hurter-Driffield curves of heat-developable photosensitive materials (K), (L), (M) and (N) in Example 17.

DETAILED DESCRIPTION OF THE INVENTION

The photosensitive silver halide of the present invention is formed by suspending or dispersing a silver salt of an organic fatty acid (d) in an organic solvent and adding an inorganic or organic halogen compound (e) to the dispersion. The silver salt of an organic fatty acid (d) is slightly soluble or insoluble in an organic solvent and contains preferably at least 5 carbon atoms. As the silver salt of organic fatty acids (d), there may be mentioned those of substituted or unsubstituted, saturated or unsaturated fatty acids such as silver salts of caproic acid, caprylic acid, capric acid, lauric acid, myristic acid, palmitic acid, stearic acid, arachidic acid, behenic acid, lignoceric acid, oleic acid, linoleic acid, linolenic acid, hydroxystearic acid and 11-bromoundecanoic acid. The silver salts of organic fatty acids having 5 or more carbon atoms are preferred, since photosensitive silver halides having a uniform particle form and particle size can be obtained from them easily. The silver salts of organic fatty acids are prepared generally by adding a solution of silver salt or silver complex such as silver nitrate or ammoniac silver nitrate to a solution of an organic fatty acid or an alkali metal salt thereof in a proper solvent.

The inorganic or organic halogen compounds (e) are those capable of forming silver halides by the reaction with the silver salts of organic fatty acids (d). As the inorganic halogen compounds, there may be mentioned compounds of the general formula:

$$MX_n$$

wherein M represents a hydrogen atom or a metal atom, such as strontium, cadmium, zinc, sodium, barium, cesium, calcium, iron, nickel, magnesium, potassium, aluminum, antimony, gold, cobalt, mercury, lead, beryllium, lithium, indium, iridium, rhodium, palladium, platinum or bismuth, X represents a chlorine, bromine or iodine atom and n represents a valence of the cation. As the inorganic halogen compounds, there may further be mentioned halogen-containing metal complexes such as $K_2PtCl_6$, $K_2PtBr_6$, $HAuCl_4$, $(NH_4)_2IrCl_6$, $(NH_4)_3IrCl_6$, $(NH_4)_3RuCl_6$ and $K_3RhCl_6$. Organic halogen compounds are also effective as the halogenating agents. Photosensitive silver halides having a uniform particle size and particle form can be obtained particularly when the organic halogen compound is used. As preferred organic halogen compounds, N-halogeno compounds of the following general formulas (I) and (II) may be mentioned:

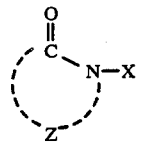
(I)

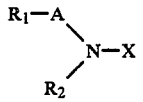
(II)

wherein X represents a chlorine, bromine or iodine atom and Z represents a group of non-metallic atoms necessary for forming a 4- to 8-membered ring, which may be condensed with another ring. Z is preferably a 5- or 6-membered ring such as a pyrrole, pyrroline, pyrrolidine, imidazoline, imidazolidine, pyrazoline, oxazolidine, piperidine, oxazine, piperazine or indole ring. Further, Z may form a 4- to 8-membered ring such as a lactam, hydantoin, cyanuric, hexahydrotriazine or indole ring. These rings may be substituted with an unsubstituted or substituted alkyl group, unsubstituted or substitued aryl group, alkoxyl group, halogen atom or oxo group. A in the above formula represents a carbonyl or sulfonyl group and $R_1$ and $R_2$ each represent a hydrogen atom, unsubstituted or substituted alkyl group, unsubstituted or substituted aryl group or alkoxyl group.

As typical examples of the compounds of the general formula (I), there may be mentioned N-bromosuccinimide, N-bromotetrafluorosuccinimide, N-bromophthalimide, N-bromoglutarimide, 1,3-dibromo-5,5-dimethyl-2,4-imidazolidinedione, N,N-dibromo-5,5-diethylbarbituric acid, N-bromoisocyanuric acid, N,N'-dibromoisocyanuric acid, N-bromooxazolinone, N-bromophthalazinone, N-chlorosuccinimide, N-iodosuccinimide, N-chlorophthalimide, N-bromosaccharin, N-bromocaprolactam, N-bromobutyrolactam and N,N'-dibromothiohydantoin.

As typical examples of the compounds of the general formula (II), there may be mentioned N-bromoacetamide, N-bromoacetanilide, N-bromobenzenesulfonylanilide, N-bromobenzamide , N-chloroacetamide, N-bromonaphthamide and N-bromo-p-hydroxybenzamide. Further, halogenated melamines may also be used. They include, for example, tribromomelamine and trichloromelamine.

As the organic halogen compounds, C-halogeno compounds of the following general formula (III) are also effective:

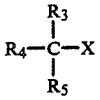

(III)

wherein X represents a chlorine, bromine or iodine atom, $R_3$, $R_4$ and $R_5$ may be the same or different and represent each a hydrogen atom, unsubstituted or substituted alkyl group, unsubstituted or substituted aryl group, nitro group, acyl group, unsubstituted or substituted amido group, unsubstituted or substituted aryl group or sulfonyl group bonded with an alkyl group or halogen atom, with a proviso that at least one of $R_3$, $R_4$ and $R_5$ represents a group which assists the release of the halogen group, such as a nitro group, unsubstituted or substituted aryl group, alkenyl group, acyl group, amido group or sulfonyl group.

As the compounds of the general formula (III), there may be mentioned, for example, α-haloketone compounds, α-halogenated amide compounds, halosulfonyl compounds, halonitro lower alkane compounds and α-haloalkenes.

As examples of the compounds of the general formula (III), there may be mentioned α-bromoacetophenone, α-chloroacetophenone, α-bromo-α-phenylacetophenone, α-brom1,3-diphenyl-1,3-propanedione, α-bromo-2,5-dimethoxyacetophenone, α-bromomethylsulfonylbenzene, α-bromo-α-benzenesulfonylacetamide, α-chloro-α-(p-tolylsulfonyl)-acetamide α-bromo-γ-nitro-β-phenylbutyrophenone, α-iodo-γ-nitro-β-phenylbutyrophenone, 2-bromo-2-nitro-1,3-propanediol, 2-bromo-2-nitrotrimethylene-1,3-bis(phenyl carbonate), α-bromotoluene, α,p-dibromotoluene, α,α'-dibromo-m-xylene, α, α, α', α'-tetrabromo-p-xylene and 3-bromopropene. Among the above-mentioned compounds, α-bromotoluene and 3-bromopropene are particularly useful.

In the present invention, onium halide compounds are also useful as the halogenating agent. Examples of them are ammonium bromide, trimethylphenylammonium chloride, cetylethyldimethylammonium bromide, trimethylbenzylammonium bromide, tetraethylphosphonium bromide and trimethylsulfonium chloride. According to the present invention, the silver salt of organic fatty acid (d) is mixed with the inorganic or organic halogen compound (e) to convert the silver salt of organic fatty acid (d) completely into a photosensitive silver halide in an organic solvent. The amount of the halogen compound (e) is stoichiometric based on the amount of the silver salt of organic fatty acid (d). However, it is preferred to use component (e) in an excess amount A range of about 1.0 to 3.0 mols per mol of component (d) is practically convenient.

The organic solvent used for the reaction of compound (d) with compound (e) according to the present invention is not particularly limited but any solvent which is liquid at a reaction temperature and in which compound (d) can be dispersed homogeneously and in which a given amount of compound (e) is soluble may be used. As the solvents, there may be mentioned alcohols, ketones, esters, ethers, aliphatic hydrocarbons, aromatic hydrocarbons and amides, either alone or in the form of a mixture of them.

As the alcohols, there may be mentioned aliphatic saturated alcohols such as methyl alcohol, ethyl alcohol, n-propyl alcohol, isopropyl alcohol, n-butyl alcohol, isobutyl alcohol, sec-butyl alcohol, n-amyl alcohol, isoaxmyl alcohol and n-hexyl alcohol; aliphatic unsaturated alcohols such as allyl alcohol and propargyl alcohol; alicyclic alcohols such as cyclopentanol and cyclohexanol; aralkyl alcohols such as benzyl alcohol and cinnamyl alcohol; and polyhydric alcohols such as ethylene glycol and glycerol.

As examples of the ketones, there may be mentioned aliphatic saturated ketones such as acetone, methyl ethyl ketone, methyl propyl ketone, isopropyl methyl ketone, butyl methyl ketone and isobutyl methyl ketone; unsaturated aliphatic ketones such as methyl vinyl ketone and methyl heptenyl ketone; alicyclic ketones such as cyclobutanone and cyclohexanone; and aromatic ketones such as acetophenone, propiophenone and butyrophenone.

As examples of the esters, there may be mentioned methyl formate, propyl formate, amyl formate, ethyl acetate, methyl acetate, butyl acetate, isobutyl acetate, methyl propionate, ethyl propionate, isopropyl propionate, methyl butyrate, ethyl butyrate, ethyl isobutyrate, methyl isovalerate, isopropyl isovalerate, methyl benzoate and ethyl phthalate.

As examples of the ethers, there may be mentioned diethyl ether, dipropyl ether, diisopropyl ether, dibutyl ether, methyl butyl ether, ethyl propyl ether and ethyl isoamyl ether; unsaturated aliphatic ethers such as diallyl ether and ethyl allyl ether, aromatic ethers such as anisole and phenyl ether; and cyclic ethers such as tetrahydrofuran and dioxane.

As the aliphatic hydrocarbons, there may be mentioned saturated aliphatic hydrocarbons such as n-heptane, n-hexane, 3-methylpentane, 2,3-dimethylbutane, cyclohexane and cycloheptane; and unsaturated aliphatic hydrocarbons such as cyclohexene, cyclopentadiene and cyclopentene.

As examples of the aromatic hydrocarbons, there may be mentioned benzene, toluene, xylene, chlorobenzene, indene and tetralin. Further, other solvents containing a nitrogen or sulfur atom such as dimethylacetamide, dimethylformamide and dimethyl sulfoxide may also be used.

Of the above-mentioned organic solvents, alcohols and ketones are particularly preferred. They may be used either alone or in the form of a mixture with another solvent. In addition, mixtures such as water/alcohol mixture and water/ketone mixture may also be used. In the production of the photosensitive silver halide according to the present invention, the silver salt of organic fatty acid (d) is suspended or dispersed in the above-mentioned organic solvent by a known dispersion technique by means of a homomixer, ball mill, sand mill or ultrasonic dispersing machine. The resulting suspension will be referred to as suspension (D). A dispersion or preferably solution of inorganic or organic halogen compound (e) in the above-mentioned organic solvent will be referred to as liquid (E). The concentrations of liquids (D) and (E) are not limited but are preferably in the range of 0.5 to 50 wt. %. Liquid (D) may be mixed with liquid (E) by a technique known in the photographic field such as a cocurrent method, a countercurrent method or a simultaneous mixing method. An easy and preferred method comprises adding liquid (E) to liquid (D) under stirring. Liquid (E) may be added to liquid (D) at once, intermittently or continuously and slowly to form the photosensitive silver halide. For obtaining silver halide particles having a uniform particle form and particle size and for growing the particles, the intermittent method or the slow, continuous method is preferred.

The time required for the addition of liquid (E) cannot be determined generally, since it varies depending on the reaction conditions such as stirring speed and reaction temperature. However, a period of the in the range of 0.5 to 5 h is preferred. The time of the termination of the reaction (from the initiation to the completion of the reaction) may be considered to be the completion of the addition of liquid (E). However, it is preferred generally to continue the reaction for 30 min to 24 h after completion of the addition of liquid (E).

In the formation of the photosensitive silver halide according to the present invention, a preferred reaction temperature is above 0° C., particularly in the range of 20° to 100° C., to facilitate the dissociation of a silver ion from the silver salt of organic fatty acid (d) and the formation of a halogen ion from the halogen compound (e). The reaction temperature is determined according to the silver salt of organic fatty acid (d), halogen compound (e) and reaction solvent. Generally, it is preferred to elevate the temperature as the alkyl chain of the silver salt of organic fatty acid (d) is elongated. In case an inorganic halogen compound is used as component (e), the reaction temperature may be slightly lower than that employed in the case of an organic halogen compound. In case an alcohol is used as a main reaction solvent, the temperature may be lower than that employed in other cases.

In the present invention, a polymer soluble in the solvent may be incorporated previously in the reaction solution, preferably in the dispersion medium of liquid (D). By the incorporation of the polymer soluble in the organic solvent, the dispersibility of salt (d) is improved, the uniform reaction of the silver salt of organic fatty acid (d) with the halogen compound (e) can be carried out and the irregular growth and aggregation of the photosensitive silver halide formed can be prevented. As the polymers usable for this purpose, there may be mentioned, for example, polyvinyl acetate, polyvinyl propionate, polymethyl methacrylate, ethylcellulose, cellulose acetate, nitrocellulose, polyethylene, ethylene/vinyl acetate copolymer, chlorinated polyethylene, polyvinyl chloride, vinyl chloride/vinyl acetate copolymer, chlorinated polypropylene, polyvinyl acetal, acrylic resin, polystyrene, epoxy resin, modified melamine resin, alkyd resin, polyamide, chlorinated rubber, acrylonitrile/butadiene/ styrene terpolymer, silicone block copolymer, polyvinylpyrrolidone, polyethylene oxide, paraffin of a high molecular weight and vinyl copolymer disclosed in the specification of U.S. Pat. No. 3,713,833. Of these polymers, preferred polymers are those soluble in an alcohol, ketone or a mixture thereof with other organic solvents. Particularly preferred polymer is polyvinyl acetal. The amount of the organic solvent-soluble polymer is in the range of about 0.05 to 20 g, preferably about 0.1 to 10 g, per gram of the silver salt of organic fatty acid (d).

The physical properties (such as particle form and particle size) of the photosensitive silver halide produced according to the present invention may be controlled by a conventional controlling technique by varying the addition rate of the halogenating agent, aging time, temperature and stirring speed. The easiest method having a high reproducibility comprises reacting the silver salt of organic fatty acid (d) with the organic halogen compound (e) stoichiometrically to form the photosensitive silver halide in the presence of at least one of inorganic cation compounds (excluding hydrogen and silver), organometallic (excluding silver compounds) organic chalcogenide compounds compounds and molecular halogens as particle-controlling agent (f). The particle-controlling agent (f) is used in an amount in the range of $1.0\times10^{-5}$ to $3.0\times10^{-1}$ mol per mol of the organic halogen compound (e). The particle size of the photosensitive silver halide particles depends on the amount of the particle size-controlling agent (f). The particle size-controlling agent (f) used in the present invention may be an inorganic or organic compound containing as constituent(s) at least one of alkali metals, alkaline earth metals, aluminum, silicon, phosphorus, sulfur, copper, zinc, scandium, gallium, titanium, germanium, vanadium, arsenic, chromium, selenium, manganese, iron, cobalt, nickel, cadmium, yttrium, indium, zirconium, tin, niobium, antimony, molybdenum, tellurium, technetium, ruthenium, rhodium, palladium, gold, mercury, lanthanoids, thallium, hafnium, lead, tantalum, bismuth, tungsten, polonium, rhenium, osmium, iridium, platinum and actinides as well as molecular halogens soluble in the organic solvent used in the reaction. The particle size-controlling agent (f) of the present invention may be dissolved in a suitable solvent and added to said liquid (D) or (E) or both liquids (D) and (E) prior to the initiation of the reaction. Alternatively, the solution of (f) may be added to the reaction solution.

As the preferred particle size-controlling agent (f) used in the present invention, there may be mentioned, for example, aqueous ammonia, ammonium chloride, ammonium bromide, ammonium hydrogensulfate, ammonium hydroxysulfate, ammonium thiosulfate, ammonium nitrate, ammonium perchlorate, ammonium iodide, lithium chloride, lithium nitrate, lithium sulfate, lithium carbonate, sodium hydroxide, sodium peroxide, sodium chloride, sodium bromide, sodium iodide, sodium nitrite, sodium thiosulfate, sodium chlorate, potassium nitrite, potassium thiocyanate, potassium bromate, potassium periodate, potassium hexacyanoferrate (III), potassium hydrogenphosphate, rubidium nitrate, rubidium carbonate, cesium iodide, cesium nitrate, beryllium bromide, beryllium nitrate, magnesium bromide, magnesium nitrate, magnesium sulfate, calcium iodide, calcium thiocyanate, calcium chlorate, strontium bromide, strontium nitrate, barium hydroxide, barium nitrite, barium thiocyanate, barium tetracyanoplatinate (II), barium permanganate, and radium chloride.

As the compounds comprising organic anions, there may be mentioned salts of saturated and unsaturated aliphatic carboxylic acids, aromatic carboxylic acids, polybasic carboxylic acids, hydroxy acids, sulfonic acids, sulfinic acids and nitrogen acids. As preferred examples, there may be mentioned ammonium acetate, lithium monochloroacetate, lithium stearate, lithium crotonate, lithium ethylsulfonate, sodium caproate, sodium laurate, sodium behenate, sodium acrylate, monosodium oxalate, disodium oxalate, disodium ethylenediaminetetraacetate, sodium benzoate, sodium salicylate, sodium α-naphthoate, sodium 3-monochlorobutyrate, sodium succinimide, sodium δ-caprolactam, sodium sultam, sodium benzenesulfonate, sodium p-toluenesulfinate, sodium sulfanylate, potassium acetate, potassium or sodium succinate, dipotassium adipate, potassium o-toluylate, dipotassium phthalate, potassium cyclohexylbutyrate, potassium sodium tartrate, potassium γ-hydroxypropionate, potassium phthalimide, rubidium acetate, cesium acetate, beryllium acetate, magnesium acetate, calcium acetate and barium caproate. Further, there may be mentioned thallium (I) hydroxide, copper hydroxide (II), silicon fluoride, tantalum fluoride, titanium fluoride, niobium fluoride, vanadium (IV , V) fluoride, bismuth (III) fluoride, arsenic (III, V) fluoride, phosphorus (III) fluoride, aluminum chloride, antimony (III) chloride, sulfur chloride, yttrium chloride, iridium (IV) chloride, indium (III) chloride, uranium (IV, V) chloride, erbium chloride, cadmium chloride, gallium (II) chloride, gold (III) chloride, chromium (II) chloride, germanium (IV) chloride, cobalt (II) chloride, samarium (III) chloride, zirconium chloride, mercury (II) chloride, tin (II, IV) chloride, cerium (III) chloride, selerium (II) chloride, thallium (III) chloride, tungsten (V, VI) chloride, tantalum (V) chloride, titanium (III, IV) chloride, iron (II, III) chloride, terbium (III) chloride, tellurium (IV) chloride, copper chloride (II), thorium chloride, niobium (V) chloride, nickel chloride, neodymium chloride, platinum (IV) chloride, vanadium (III, IV) chloride, palladium (II) chloride, bismuth chloride, arsenic (III) chloride, praseodymium (III) chlorine, manganese (II) chloride, molybdenum (V) chloride, radium chloride, lanthanum chloride, phosphorus chloride, ruthenium (III, IV) chloride, rhenium (IV) chloride, rhodium chloride, zinc bromide, aluminum bromide, antimony bromide, cadmium bromide, gold (III) bromide, chromium (III) bromide, germanium (II, IV) bromide, cobalt bromide, mercury (II) bromide, tin (II, IV) bromide, thallium (I, III) bromide, tungsten bromide, tantalum (V) bromide, titanium (IV) bromide, iron (II, III) bromide, copper (II) bromide, nickel bromide, platinum (IV) bromide, vanadium (III) bromide, bismuth (III) bromide, manganese (II) bromide, radium bromide, phosphorus (III) bromide, zinc iodide, aluminum iodide, antimony (III) iodide, cadmium iodide, germanium (IV) iodide, cobalt (II) iodide, mercury (II) iodide, tin (IV) iodide, thallium (I) iodide, tungsten (IV) iodide, nickel iodide, bismuth iodide, arsenic (III) iodide, cadmium nitrate, chromium (III) nitrate, cobalt nitrate, mercury (II) nitrate, scandium nitrate, cerium nitrate, thallium nitrate, iron (III) nitrate, copper (II) nitrate, thorium nitrate, nickel nitrate, neodymium nitrate, bismuth (III) nitrate, manganese nitrate, lanthanum nitrate, lead (II) sulfite, gallium (III) sulfate, chromium (III) sulfate, cobalt (II) sulfate, copper (II) sulfate, nickel sulfate, lanthanum sulfate, zinc thiocyanate, mercury (II) thiocyanate, iron (III) thiocyanate, copper (I) thiocyanate, uranium (VI) oxysulfate, uranium (VI) oxynitrate, chromium (VI) oxychloride, zirconium oxychloride, niobium oxychloride, vanadium (V) oxychloride, bismuth (III) oxychloride, arsenic sulfide, zinc acetate, cobalt (II) acetate, mercury (II) acetate, chromium (III) acetate, nickel acetate, palladium (II) acetate, thallium (I) acetate, lead (II) acetate, cadmium acetate, manganese (II) acetate, lanthanum acetate, cadmium propionate, thallium malonate, zinc terephthalate, lead methanesulfonate, mercury (II) succinimidate, triphenylsilane, trimethylphosphine, dimethylethylphosphine, triphenylphosphine, diphenylphosphine, tri-P-tolylphosphine, tri-P-chlorophenylphosphine, triphenylphosphine selenide, trimethylarsenic, triphenylarsenic, antimony triacetates triphenylantimony, trimethylbismuth, triphenylbismuth, diethyl sulfide, diethyl selenide, dimethyl selenide, bis(p-methoxyphenyl) selenide, diphenyl telluride, phenylgermanium bromide, triphenyltin bromide, tris(p-methoxyphenyl)bismuth dibromide, phenylarsenic dichloride, diphenyltellurium diiodide, aqueous bromine solution, pyridine/bromine adduct and iodine.

A preferred embodiment of the procedure of preparing the photosensitive silver halide of the present invention will now be described.

A silver salt of an organic fatty acid is homogeneously dispersed in an organic solvent such as n-butanol. Then, a polymer soluble in the organic solvent (such as polyvinyl butyral) is added to the dispersion and stirred to obtain a polymer-containing suspension or dispersion of the silver salt of an organic fatty acid. An inorganic or organic halogen compound dissolved in a proper organic solvent such as acetone is added intermittently or slowly and continuously to the dispersion while the dispersion is maintained at a given temperature under stirring under the irradiation with a safety light for about 0.5 to 5 h, preferably 0.5 to 3 h. After completion of the addition, the reaction is continued at the reaction temperature for about 0.5 to 24 h, preferably 0.5 to 8 h. After completion of the reaction, the reaction liquid is cooled to room temperature to obtain a mixed dispersion of a photosensitive silver halide, by-produced organic fatty acids or organic fatty acid salts free of silver cation.

The photosensitive silver halides prepared by the process of the present invention include silver chloride, silver iodide, silver bromide, silver bromochloride, silver iodobromide, silver iodochloride and silver iodobromochloride.

The characteristic sensitivity of the photosensitive silver halide prepared by the process of the present invention can be enhanced by a known chemical sensitization method employed for the sensitization of a wet silver halide emulsion such as sulfur sensitization, gold sensitization or reduction sensitization method.

As examples of the chemical sensitizers, there may be mentioned sulfur sensitizers and gold sensitizers such as sodium thiosulfate, ammonium thiosulfate, allyl isothiocyanate, sodium sulfide, potassium thiocyanate, chloroauric acid and potassium chloroaurate; and reduction sensitizers such as tin chloride, hydrazine compounds and thiourea dioxide.

The photosensitive silver halide prepared by the present invention can be sensitized spectroscopically by a known sensitization method using, for example, cyanine dyestuff, styryl dyestuff, hemicyanine dyestuff, triphenylmethane dyestuff, xanthene dyestuff, oxonol dyestuff, merocyanine dyestuff and particularly those mentioned in "Product Licensing Index" 92, 107–110 (published: Dec. 1971) and the specification of Belgian Pat. No. 772371 (U.S. Pat. No. 3,761,279).

The photosensitive silver halide thus prepared by the present invention can be used as an image-forming component of a wet silver halide emulsion. Further, it has characteristics quite suitable for use as a photosensitive component for an oxidation-reduction image-forming component. Thus, by using the photosensitive silver halide prepared by the present invention, a heat-developable photosensitive material having excellent photographic properties can be provided.

The photosensitive silver halide prepared according to the present invention can be used as a photosensitive silver halide (b) in a heat-developable photosensitive material having at least one layer of a photosensitive composition comprising oxidation-reduction image-forming components (a) consisting of a reducible organic silver salt and a reducing agent, the photosensitive silver halide (b) and a binder (c).

After intensive investigations on such a photosensitive silver halide, the inventors have found that the silver halide in the form of fine particles having a diameter of around 0.1$\mu$ is preferred and that silver halide particles in the form of the normal crystal of [1.0.0] are particularly effective. The inventors have further found that a photosensitive silver halide formed by the reaction of a silver salt of organic fatty acid suspended or dispersed in the above-mentioned organic solvent with an inorganic or organic halogen compound satisfies the above-mentioned conditions and is preferred in the production of the heat-developable photosensitive materials.

Reasons why these photosensitive silver halides satisfy the above-mentioned conditions are as follows:

(1) The photosensitive silver halide prepared by the process of the present invention is in the form of fine particles having a narrow particle size distribution and capable of providing a heat-developable photosensitive material which brings about a high image density and a high contrast.

(2) The photosensitive silver halide prepared by the process of the present invention can be used advantageously for the production of heat-developable photosensitive materials, since it is dispersed in an organic solvent easily and stably.

(3) A dispersion of the photosensitive silver halide prepared by the process of the present invention does not cause serious fog in the heat development step even if a washing operation such as reprecipitation, decantation or centrifugal separation is omitted.

In the heat-developable photosensitive material of the present invention, the three components (a), (b) and (c) are contained as indispensable components in at least one layer. The reducible organic silver salt in the oxidation-reduction image-forming component (a) comprising the reducible organic silver salt and reducing agent is a colorless, white or a light-colored silver salt having a relatively high stability to light. By exposure, silver halide contained in the composition gives metallic silver. Upon heating to a temperature of above 80° C., preferably above 100° C., the metallic silver acts as a nucleus and the reducible organic silver salt is reacted with the reducing agent to form a silver image. More concretely, the reducible organic silver salt is a silver salt of an organic acid or an organic compound containing an imino or mercapto group disclosed in the specifications of Japanese Patent Publication No. 4924/1968 (U.S. Pat. No. 3,457,075) and Japanese Patent Laid-Open No. 6074/1971 (U.S. Pat. No. 3,672,904). Particularly, silver salts of long-chain fatty acids having 12 to 24 carbon atoms are preferred, since they do not suffer from deterioration such as darkening under room light.

As the reducible organic silver salts, there may be mentioned, for example, silver behenate, silver stearate, silver palmitate, silver myristate, silver laurate, silver oleate and silver hydroxystearate. Among them, silver behenate is most effective. The reducible organic silver salt may be partially converted into a silver halide by methods shown in the specifications of Japanese Patent Publication No. 4924/1968 (U.S. Pat. No. 3,457,075) and Japanese Patent Publication No. 40484/1978 (British Pat. No. 1,498,956).

As the reducing agents contained in the oxidation-reduction image-forming component, there may be mentioned various reducing agents. They include developing agents generally used for developing ordinary silver halide photosensitive materials such as hydroquinone, methylhydroquinone, chlorohydroquinone, methylhydroxynaphthalene, N,N'-diethyl-p-phenylenediamine, aminophenol, ascorbic acid and 1-phenyl-3-pyrazolidone. In addition, there may be mentioned 2,2'-methylenebis(6-t-butyl-4-methylphenol), 4,4'-butylidenebis(6-t-butyl-3-methylphenol) and 4,4'-thiobis(6-t-butyl-3-methylphenol). Further, there may be mentioned bisnaphthol reducing compounds disclosed in the specification of Japanese Patent Laid-Open No. 6074/1971 (U.S. Pat. No. 3,672,904) and sulfonamidophenol compounds disclosed in the specification of Belgian Pat. No. 802,519 (U.S. Pat. No. 3,801,321) such as 4-benzenesulfonamidophenol compounds. These reducing agents may be used either alone or in the form of a mixture of two or more of them. The amount of the reducing agent is about 0.05 to 5 mols, preferably about 0.2 to 3 mols, per mol of the reducible organic silver salt.

The photosensitive silver halide (b) in the present invention is a member or a mixture of two or more members of the group consisting of silver chloride, silver bromide, silver iodide, silver bromochloride, silver iodochloride, silver iodobromide and silver iodobromo-chloride prepared by the above-mentioned method. A preferred photosensitive silver halide (b) contains at least 30 molar % of silver bromide and is prepared from a silver salt of an organic fatty acid having at least 5 carbon atoms, preferably at least 16 carbon atoms.

The photosensitive silver halide (b) thus formed is mixed with a dispersion containing the reducible organic silver salt as such (i.e. containing by-products) or after washing by reprecipitation, decantation or centrifugal separation followed by the re-dispersion. The photosensitive silver halide (b) may be added to the mixture at any stage in the production of the heat-developable photosensitive material with a proviso that it can be incorporated in a layer in contact with the reducible organic silver salt. The homogeneous dispersion of the photosensitive silver halide and the reducible organic silver salt may be obtained easily by using an ordinary stirrer, ball mill or ultrasonic dispersion device. The amount of the photosensitive silver halide (b) is in the range of about 0.01 to 0.5 mol, preferably about 0.05 to 0.3 mol, per mol of the reducible organic silver salt. If the amount of the photosensitive silver halide (b) is less than 0.01 mol, the practical photographic characteristics cannot be obtained, and if it exceeds 0.5 mol, the background color change after the image formation becomes significant.

The binders (c) of the present invention may be used either alone or in the form of a combination of two or more of them. Suitable materials of the binder may be either hydrophobic or hydrophilic and transparent or semi-transparent. As binders (c), there may be mentioned polyvinyl butyral, cellulose acetate butyrate, polymethyl methacrylate, polyvinylpyrrolidone, ethylcellulose, cellulose acetate, polyvinyl acetate, polyvinyl alcohol, gelatin and those containing sulfobetaine recurring units disclosed in the specification of Canadian Pat. No. 774,054. Particularly, polyvinyl butyral is preferred. As for the amount of the binder, weight ratio thereof to the reducible organic silver salt is preferably about 10:1 to 1:10, particularly about 4:1 to 1:2.

It is preferred for obtaining a black image to add one or more toning agents to the heat-developable photosensitive material of the present invention. As the toning agents, there may be mentioned, for example, phthalazinone and derivatives thereof disclosed in the specification of U.S. Pat. No. 3,080,254, cyclic imides disclosed in the specification of Japanese Patent Laid-Open No. 6074/1971 (U.S. Pat. No. 3,672,904), phthalazinedione compounds disclosed in the specification of Japanese Patent Laid-Open No. 32927/1975 and a combination of phthalazine and phthalic acid disclosed in the specification of U.S. Pat. No. 3,994,732.

The heat-developable photosensitive material of the present invention may contain a known fog-inhibitor to prevent the heat fog caused in the development step. As the fog-inhibitors, there may be mentioned, for example, mercury compounds disclosed in the specification of Japanese Patent Publication No. 11113/1972 (U.S. Pat. No. 3,589,903), N-halogenated compounds disclosed in the specifications of Japanese Patent Laid-Open No. 10724/1974 (British Pat. No. 1,389,501), Japanese Patent Publication No. 25808/1979 (U.S. Pat. No. 4,055,432) and Japanese Patent Publication No. 23813/1979 (U.S. Pat. No. 3,957,493), and higher fatty acids such as stearic acid and behenic acid and acid stabilizers such as salicylic acid, tetrabromobenzoic acid, phthalic acid and trimellitic acid disclosed in the specifications of U.S. Pat. No. 3,645,739 and Japanese Patent Laid-Open No. 89720/1973 (U.S. Pat. No. 3,816,132).

The heat-developable photosensitive material of the present invention may contain a suitable spectral sensitizer. Useful sensitizing dyestuffs include cyanine dyestuff, merocyanine dyestuff, xanthene dyestuff and particularly those disclosed in "Product Licensing Index" Vol. 92, pp. 107–110 (published: Dec., 1971) or in the specifications of Belgian Pat. No. 772,371 (U.S. Pat. No. 3,761,279), Japanese Patent Laid-Open No. 105127/1975 (British Pat. No. 1,466,201) and Japanese Patent Laid-Open Nos. 127719/1976 and 80829/1977.

Further, the heat-developable photosensitive material of the present invention may contain compounds for preventing the photo-discoloration after the image formation, such as azole thioethers and blocked azolethiones disclosed in the specification of U.S. Pat. No. 3,839,041, tetrazolylthione compounds disclosed in the specification of U.S. Pat. No. 3,700,457, halogen-containing organic oxidizing agents disclosed in the specification of U.S. Pat. No. 3,707,377 and 1-carbamoyl-2-tetrazoline-5-thiones disclosed in the specification of U.S. Pat. No. 3,893,859. Other suitable additives such as development accelerators, hardening agents, antistatics (layer), U.V. absorbers, fluorescent brightening agents and filter dyes (layer) may also be used.

The heat-developable photosensitive material of the present invention may be obtained by dispersing or dissolving components (a) (reducible organic silver salt and reducing agent), photosensitive silver halide (b) and binder (c) and the above-mentioned additives in a proper solvent and applying the dispersion or solution to a base to form one or more layers. A top polymer layer may be formed on the formed one or more heat-developable photosensitive layers. As polymers suitable for forming the layer, there may be mentioned, for example, polyvinyl butyral, polystyrene, polymethyl methacrylate, polyurethane rubber, chlorinated rubber, ethylcellulose, cellulose acetate butyrate, cellulose acetate, polyvinyl chloride, polyvinylidene chloride, polycarbonate and polyvinylpyrrolidone.

Further, these polymers may be used for forming a prime coat and the heat-developable photosensitive layer of the present invention may be formed thereon.

The bases used in the present invention may be selected over a broad range. As typical bases, there may be mentioned synthetic resin films such as polyethylene, polypropylene, polyethylene terphthalate, polycarbonate and cellulose acetate films, synthetic papers, papers coated with a film of a resin such as polyethylene, art papers, photographic baryta papers, plates or foils of metals such as aluminum, synthetic resin films having a vacuum-deposited metal film formed by an ordinary method and glass plates.

The coating may be effected by a known method such as roll coating method, air knife coating method, kiss coating method, curtain coating method, bar coating method and hopper coating method.

The heat-developable photosensitive material of the present invention is exposed to light from xenon lamp, mercury lamp, tungsten lamp or CRT or laser beams and then developed by heating to a temperature in the range of 80° to 180° C., preferably 110° to 150° C. The development may also be effected at a temperature not within the above-mentioned range if the heating time is prolonged or reduced. However, the development time is preferably about 1 to 60 sec in general. The heating for the development is effected generally by contacting the film with a heating plate or heating drum. Alternatively, the film may be maintained in a heated atmosphere for a while or the heating may be effected by high-frequency induction heating or by means of infrared rays.

The following examples will further illustrate the present invention.

EXAMPLE 1

3.9 g of silver stearate was added to 100 ml of isopropyl alcohol and the mixture was treated by means of a homomixer. 3 g of polyvinyl butyral was added to the resulting dispersion and the mixture was stirred to obtain a dispersion of the silver salt in the polymer. The dispersion was heated to control the temperature thereof at 50° C. The procedures were conducted a red safety light. A solution of 0.9 g of lithium bromide in 30 ml of acetone was added dropwise to the dispersion under stirring over 1 h. After completion of the addition, the stirring was continued for additional 2 h while the temperature was kept at the reaction temperature. Then the temperature was lowered to room temperature to obtain dispersion (1) of a photosensitive silver halide. In the dispersion (1), no precipitate was formed even after it was left to stand for a long time. Part of the dispersion was diluted to about 1/5 concentration with xylene/n-butanol (volume ratio: 50/50) and then centrifuged (6000 rpm). A supernatant liquid in which polyvinyl butyral was dissolved was removed by decantation.

The residue was dried on a glass plate to obtain sample (I). From electron microphotographs (1,000, 10,000 and 30,000 magnifications) of the sample (I) taken by the replica method, form and particle size distribution of the silver halide particles were examined (in the following examples and comparative examples, the examinations were effected in the same manner). The results are shown in Table 1.

TABLE 1

| Sample | Crystal form of silver halide | Particle size of silver halide | Coexistent compound |
|---|---|---|---|
| (I) | normal crystal of [1.0.0] | 0.03 to 0.05μ | lithium stearate |

From the results shown in Table 1, it is understood that silver halide prepared by the present invention is a quite fine particle of a uniform particle form having a narrow particle size distribution.

COMPARATIVE EXAMPLE 1

Silver halide was prepared according to the method of British Pat. No. 1,362,970. 5 ml of a 2.35 mol aqueous silver nitrate solution was mixed with 150 ml of a solution of 7.5 g of polyvinyl butyral in acetone/toluene (volume ratio: 50/100) and the mixture was treated by means of ultrasonic waves. To the resulting emulsion, 50 ml of a 0.23 mol solution of lithium bromide in acetone was added dropwise over about 2 min, at 25° C., while the ultrasonic dispersion treatment was continued to obtain a dispersion (1). Part of the dispersion (1) was diluted with ethanol and polyvinyl butyral was removed by the centrifugation to obtain sample (1). The results are shown in Table 2.

TABLE 2

| Sample | Crystal form of silver halide | Particle size of silver halide | Coexistent compound |
|---|---|---|---|
| (1) | various twins | 0.1 to 1.0μ | none* |

*In the following, a (*) indicates this compound was removed in the step of preparing the sample From the results shown in Table 2, it is understood that the photosensive silver halide prepared by this process had nonuniform crystal forms and a broad particle size distribution.

COMPARATIVE EXAMPLE 2

Silver halide was prepared according to the method of Japanese Patent Publication No. 17415/1977 (U.S. Pat. No. 3,871,887). 40 ml of a solution of 1.2 g of lithium bromide and 2.4 g of polyvinyl butyral in acetone was maintained at 30° C. 40 ml of a solution of 3.0 g of silver trifluoroacetate in acetone was added dropwise to the above solution over 2 min to prepare a dispersion (2). 40 ml of the obtained dispersion (2) was immediately thrown into 400 ml of water under stirring to obtain a precipitate. The precipitate was filtered and dried to obtain a solid (2') (silver bromide/polyvinyl butyral). The solid was again dissolved in 100 ml of xylene/n-butanol (volume ratio: 50/50). A sample (2) for the electron microscopic examination was prepared in the same manner as in Example 1. Separately, the silver halide dispersion obtained as above containing trifluoroacetate anion and lithium cation was left to stand for 2 h to obtain a dispersion (3) containing a partial precipitation. The dispersion (3) was treated in the same manner as in Example 1 to obtain a sample (3) for the electron microscopic examination. The results are shown in Table 3.

TABLE 3

| Sample | Crystal form of silver halide | Particle size of silver halide | Coexistent compound |
|---|---|---|---|
| (2) | various twins | 0.08 to 0.3μ | none* |
| (3) | " | 0.12 to 0.45μ | none* |

From the results shown in Table 3, it is understood that the photosensitive silver halide prepared by this process had nonuniform crystal forms and that the particle size was inclined to increase while the dispersion was left to stand.

EXAMPLE 2

4.5 g of silver behenate was poured in 100 ml of ethanol. The mixture was treated by means of a homomixer to obtain a dispersion. 3 g of polyvinyl butyral was added to the dispersion and the mixture was stirred to obtain a dispersion of the silver salt in the polymer. The dispersion was heated to 45° C. under irradiation with red safety light. A solution of 1.0 g of ammonium bomide in 30 ml of methanol was added dropwise to the dispersion over 30 min. After completion of the addition, the stirring was continued at that temperature for 1 h. Thereafter, the temperature of the dispersion was lowered to room temperature to obtain dispersion (II). Even after the dispersion (II) was left to stand for a long time, the precipitation of the silver halide was not observed. A sample (II) was prepared from the dispersion (II) in the same manner as in Example 1. A dispersion (III) was prepared in the same manner as in the preparation of dispersion (II) except that the reaction temperature was altered to 60° C. A sample (III) was prepared from the dispersion III). Further, a dispersion (IV) was prepared under the same conditions as in the preparation of dispersion (III) except that ammonium bromide was replaced with 0.56 g of ammonium chloride. A sample (IV) was prepared from dispersion (IV). The results of the electron microscopic examination of the samples are shown in Table 4.

TABLE 4

| Sample | Crystal form of silver halide | Particle size of silver halide | Coexistent compound |
|---|---|---|---|
| (II) | normal crystal of [1.0.0] | 0.08 to 0.15μ | none* |
| (III) | various twins | 0.1 to 0.2μ | none* |
| (IV) | normal crystal of [1.0.0] | 0.1 to 0.2μ | none* |

From the results shown in Table 4, it is understood that fine silver halide particles having a narrow particle size distribution can be obtained by the present invention.

EXAMPLE 3

A dispersion (V) was obtained in the same manner as in the preparation of dispersion (II) in Example 2 except that ammonium bromide/methanol was replaced with 30 ml of 1.25 g potassium bromide-ethanol/glycerol (volume ratio: 50/50). The dispersion (V) formed a precipitate at room temperature. The precipitate was separated out by decantation and dispersed again in a solution of 3 g of polyvinyl butyral in 100 ml of a mixture of xylene/n-butanol to obtain an excellent dispersion. A sample (V) was prepared from the dispersion. A dispersion (VI) was prepared in the same manner as in the preparation of dispersion (II) except that ammonium bromide-methanol was replaced with a solution of 3.8 g of mercuric bromide in 30 ml of methanol. A sample (VI) was prepared from the dispersion (VI). The results of the electron microscopic examination of the samples (V) and (VI) are shown in Table 5.

TABLE 5

| Sample | Crystal form of silver halide | Particle size of silver halide | Coexistent compound |
|---|---|---|---|
| (V) | various twins | 0.08 to 0.2μ | potassium behenate |
| (VI) | normal crystal of [1.0.0] | 0.1 to 0.2μ | mercury behenate |

From the results shown in Table 5, it is understood that the photosensitive silver halide particles obtained by the present invention were fine and had a narrow particle size distribution.

EXAMPLE 4

100 ml of xylene/n-butanol dispersion (volume ratio: 50/50) containing 2.5 g of silver caprate and 6 g of polyvinyl buryral was prepared. The dispersion was divided into two equal parts. They were maintained at 20° C. and 45° C., respectively. The procedures were conducted under a red safety light. A solution of 0.93 g of N-bromosuccinimide in 15 ml of acetone was added dropwise thereto under stirring for one hour. After completion of the addition, the reaction was continued for additional 12 h (at 20° C.) or 2 h (at 45° C.). The temperature was lowered to room temperature to obtain dispersions (VII) and (VIII). The resulting dispersions were quite stable. Samples (VII) and (VIII) were prepared from the dispersions. The same procedure as above was repeated except that 3.6 g of silver palmitate or 4.5 g of silver behenate was used to obtain samples (IX), (X), (XI) and (XII). The reaction conditions and results of the electron microscopic examination are shown in Table 6.

TABLE 6

| Sample | Silver salt of organic fatty acid | Reaction temp. | Reaction time** | Crystal form of silver halide | Particle size of silver halide | Coexistent compound |
|---|---|---|---|---|---|---|
| (VII) | silver caprate | 20° C. | 13 h | normal crystal of [1.0.0] | 0.08 to 0.1μ | small amount of silver caprate |
| (VIII) | silver caprate | 45° C. | 3 h | spherical | 0.1 to 0.3μ | none* |
| (IX) | silver palmitate | 50° C. | 10 h | normal crystal of [1.0.0] | 0.1μ | none* |
| (X) | silver palmitate | 60° C. | 3 h | spherical | 0.1 to 0.15μ | none* |
| (XI) | silver behenate | 60° C. | 3 h | normal crystal of [1.0.0] | 0.08 to 0.15μ | none* |
| (XII) | silver behenate | 80° C. | 3 h | spherical | 0.1 to 0.2μ | none* |

**The term "reaction time" means a time from the initiation of the addition of N—bromosuccinimide to the completion of the reaction.

From the results shown in Table 6, it is understood that when an N-halogenated compound is used as the organic halogen compound, fine silver halide particles having a uniform particle form and a narrow particle size distribution can be obtained.

EXAMPLE 5

4.5 g of silver behenate was dispersed in 100 ml of each one of the following 9 solvents: ethanol, n-propanol, isopropyl alcohol, n-butanol, isobutyl alcohol, sec-butanol, benzyl alcohol, methyl ethyl ketone and n-propanol/toluene (volume ratio: 50/50). 2 g of polyvinyl butyral was added to the dispersion and the mixture was stirred to obtain a dispersion of a silver salt in the polymer. Each dispersion was heated to 60° C. A solution of 1.5 g of N-bromoacetamide in 30 ml of acetone was added slowly to the dispersion over 1 h and then the reaction was carried out for additional 2 h. The reaction mixture was cooled to room temperature and samples (XIII) to (XXI) were prepared from the resulting dispersions. The results of the electron microscopic examination are shown in Table 7.

TABLE 7

| Sample | Reaction solvent | Crystal form of silver halide | Particle size of silver halide | Coexistent compound |
|---|---|---|---|---|
| (XIII) | ethanol | normal crystal of [1.0.0] | 0.10 to 0.13μ | none* |
| (XIV) | n-propanol | normal crystal of [1.0.0] | 0.09 to 0.11μ | " |
| (XV) | iso-propyl alcohol | normal crystal of [1.0.0] | " | " |
| (XVI) | n-butanol | normal crystal of [1.0.0] | " | " |
| (XVII) | iso-butyl alcohol | normal crystal of [1.0.0] | 0.08 to 0.10μ | " |
| (XVIII) | sec-butanol | normal crystal of [1.0.0] | 0.05 to 0.08μ | " |
| (XIX) | benzyl alcohol | normal crystal | 0.08 to 0.13μ | " |

TABLE 7-continued

| Sample | Reaction solvent | Crystal form of silver halide | Particle size of silver halide | Coexistent compound |
|---|---|---|---|---|
| | | of [1.0.0] | | |
| (XX) | methyl ethyl ketone | normal crystal of [1.0.0] | 0.10 to 0.11μ | a small amount of silver behenate |
| (XXI) | n-propanol/toluene | normal crystal of [1.0.0] | 0.10 to 0.12μ | none* |

From the results shown in Table 7 it is understood that when an alcohol, ketone or a mixture of an alcohol with another organic solvent is used, fine silver halide particles having a uniform particle form and a narrow particle size distribution can be obtained.

EXAMPLE 6

A silver iodobromide dispersion (XXII) was prepared in the same manner as in the preparation of sample (XIV) in Example 5 except that a mixture of 1.8 g of N-bromosuccinimide and 0.12 g of N-iodosuccinimide was used as the halogen compound and that the reaction temperature was 75° C. A sample (XXII) was prepared from the dispersion. The results of the electron microscopic examination are shown in Table 8.

TABLE 8

| Sample | Crystal form of silver halide | Particle size of silver halide | Coexistent compound |
|---|---|---|---|
| (XXII) | normal crystal of [1.0.0] | 0.10 to 0.15μ | none* |

From the results shown in Table 8, it is understood that when silver iodobromide is used as the silver halide, fine silver halide particles having a uniform particle form and a narrow particle size distribution can also be obtained.

EXAMPLE 7

2.3 g of silver behenate was dispersed in 50 ml of cyclohexanol. 1.5 g of polyvinyl butyral was added to the dispersion and the mixture was stirred to obtain a dispersion of the silver salt in the polymer. The dispersion was heated to 80° C. 1.3 g of α-bromotoluene diluted with acetone into a volume of 30 ml was added dropwise to the dispersion over 2 h .

The reaction was continued for additional 1 h. The reaction mixture was cooled to room temperature to obtain a dispersion (XXIII). A sample (XXIII) was prepared from the dispersion (XXIII). Further, a sample (XXIV) was prepared in the same manner as above except that α-bromotoluene was replaced with 2.4 g of 3-bromopropene. The results of the electron microscopic examination are shown in Table 9.

TABLE 9

| Sample | Crystal form of silver halide | Particle size of silver halide | Coexistent compound |
|---|---|---|---|
| (XXIII) | normal crystal of [1.0.0] | 0.1 to 0.3μ | none* |
| (XXIV) | normal crystal of [1.0.0] | 0.12 to 0.28μ | " |

From the results shown in Table 9, it is understood that when a C-halogeno compound is used as the organic halogen compound, fine silver halide particles having a uniform particle form and a narrow particle size distribution can also be obtained.

EXAMPLE 8

A dispersion (XXV) was prepared under the same conditions as in the preparation of sample (XIII) in Example 5 except that polyvinyl butyral used as the protective colloid was replaced with an equal amount of nitrocellulose. A sample (XXV) was prepared from the resulting dispersion. The results of the electron microscopic examination are shown in Table 10.

TABLE 10

| Sample | Crystal form of silver halide | Particle size of silver halide | Coexistent compound |
|---|---|---|---|
| (XXV) | normal crystal of [1.0.0] | 0.09 to 0.13μ | none* |

From the results shown in Table 10, it is understood that when nitrocellulose is used as the protective colloid, fine silver halide particles having a uniform particle form can also be obtained.

EXAMPLE 9

Samples (XXVI) to (XXXVI) were prepared in the same manner as in the preparation of sample (XIII) in Example 5 except that 0.2 molar %, based on N-bromoacetamide, of one of 11 compounds (particle-controlling agents) shown in Table 11 was added to the N-bromoacetamide solution. The results of the electron microscopic examination are shown in Table 11.

TABLE 11

| Sample | Compound added | Crystal form of silver halide | Particle size of silver halide |
|---|---|---|---|
| (XIII) | — | normal crystal of [1.0.0] | 0.10 to 0.13μ |
| (XXVI) | $(C_6H_5)_3P$ | normal crystal of [1.0.0] | 0.06 to 0.07μ |
| (XXVII) | $C_6H_5GeBr$ | normal crystal of [1.0.0] | 0.07 to 0.09μ |
| (XXVIII) | $FeCl_2$ | normal crystal of [1.0.0] | 0.05 to 0.06μ |
| (XXIX) | $FeCl_3.6H_2O$ | normal crystal of [1.0.0] | 0.05 to 0.06μ |
| (XXX) | $SnI_4$ | normal crystal of [1.0.0] | 0.06 to 0.07μ |
| (XXXI) | $Pb(CH_3COO)_2$ | normal crystal of [1.0.0] | 0.05 to 0.06μ |
| (XXXII) | $Pd(CH_3COO)_2$ | normal crystal of [1.0.0] | 0.07 to 0.09μ |
| (XXXIII) | $(C_6H_5)_3Bi$ | normal crystal of [1.0.0] | 0.06 to 0.07μ |
| (XXXIV) | $IrCl_4$ | normal crystal of [1.0.0] | 0.07 to 0.09μ |
| (XXXV) | $CH_3COOLa$ | normal crystal of [1.0.0] | 0.05μ |
| (XXXVI) | $I_2$ | normal crystal of [1.0.0] | 0.05 to 0.06μ |

From the results shown in Table 11, it is understood that by using the particle-controlling agent, finer silver halide particles can be obtained.

EXAMPLE 10

Samples (XXXVII) to (XXXIX) were prepared in the same manner as is Example 9 except that sodium bromide was used as the particle-controlling agent in an amount shown in Table 12. The results of the electron microscopic examination are shown in Table 12. The amount of sodium bromide used was shown in terms of molar % based on N-bromoacetamide.

TABLE 12

| Sample | Sodium bromide | Crystal form of silver halide | Particle size of silver halide |
|---|---|---|---|
| (XIII) | — | normal crystal of [1.0.0] | 0.10 to 0.13μ |
| (XXXVII) | 0.01 | normal crystal of [1.0.0] | 0.07 to 0.09μ |
| (XXXVIII) | 0.1 | normal crystal of [1.0.0] | 0.05 to 0.07μ |
| (XXXIX) | 1.0 | normal crystal of [1.0.0] | 0.03 to 0.04μ |

From the results shown in Table 12, it is understood that the silver halide particles formed become finer as the amount of the particle-controlling agent is increased.

EXAMPLE 11

51 g of silver behenate and 39 g of behenic acid were added to a dispersion medium mixture comprising 440 ml of xylene and 440 ml of n-butanol. The mixture was treated by means of a homomixer to obtain a dispersion. 80 g of polyvinyl butyral was added as a binder to the dispersion and the mixture was stirred to obtain a dispersion of the silver salt in the polymer. The dispersion was divided into 82 g portions Each portion was mixed with a silver bromide dispersion shown below:

A. 10.0 g of dispersion (1) prepared in Example 1

B. 10.0 g of dispersion (2) prepared in Comparative Example 2, and

C. 0.42 g of solid (2') prepared in Comparative Example 2 and re-dissolved in 100 ml of xylene/n-butanol (volume ratio: 50/50).

The following components were added successively to each of the three silver bromide-containing silver behenate dispersions in the polymer to obtain photosensitive slurries:

a solution of 4 g of 1,1'-bis(2-hydroxy-3, 5-dimethylphenyl)-3,5,5-trimethylhexane in 10 ml of ethanol,
mercuric acetate: 0.005 g
1-carboxymethyl-5-[(3-ethylnaphth[1,2-d]oxazolin-2-ylidene)-ethylidene]-3-allylthiohydantoin 0.0013 g The photosensitive slurry comprising the above three components was applied to an art paper having 1 g/m$^2$ of an undercoating of vinyl chloride/vinyl acetate (weight ratio: 87:13) in such a manner that the amount of silver would be 0.55 g/m$^2$ and then dried. A top coating composition comprising the following compounds was applied thereon at a rate of 1.5 g (dry)/m$^2$. Thus, three samples (A), (B) and (C) for the image test were obtained. The above operations were effected under a red safety light.

Top coating composition:
cellulose acetate: 15.0 g
phthalazinone: 7.5 g
acetone: 300 ml The above samples (A), (B) and (C) were exposed to 700 lux.sec of tungsten light through an optical wedge (Kodak Step Tablet No. 2). After the heat development at 125° C. for 10 sec, stepwise images according to the quantities of the light were obtained. Sensitivity (S), gradient ($\bar{r}$), maximum reflection density ($D_{max}$) and heat fog density ($D_{min}$) of the images obtained were determined (the determination in the following examples were effected in the same manner as above). The results are shown in Table 13. The sensitivity in Table 13 is a reciprocal of a quantity of exposure light required for obtaining a density of "heat fog+0.15" which is represented by a relative sensitivity taking a sensitivity of sample (B) as 100 (the same shall apply hereinafter).

TABLE 13

| Sample | Silver halide dispersion | S | $\bar{r}$ | $D_{max}$ | $D_{min}$ |
|---|---|---|---|---|---|
| (A) | (1) | 100 | 3.2 | 1.65 | 0.21 |
| (B) | (2) | 100 | 1.5 | 1.50 | 0.20 |
| (C) | (2') | 100 | 1.7 | 1.53 | 0.22 |

From the results shown in Table 13, it is understood that as compared with conventional samples (B) and (C), the sample (A) of the present invention has higher contrast and density.

EXAMPLE 12

Samples (D) and (E) were prepared in the same manner as in Example 11 and their photographic characteristics were examined. As the silver halide dispersion, the following silver bromide dispersions were used:

D. dispersion (IX) prepared in Example 4: 11.0 g

E. dispersion (XI) prepared in Example 4: 11.0 g

The results are shown in Table 14.

TABLE 14

| Sample | Silver halide dispersion | S | $\bar{r}$ | $D_{max}$ | $D_{min}$ |
|---|---|---|---|---|---|
| (D) | (IX) | 850 | 3.3 | 1.81 | 0.25 |
| (E) | (XI) | 600 | 3.4 | 1.76 | 0.20 |

From the results shown in Table 14, it is understood that the heat-developable photosensitive material containing the silver halide prepared from the silver salt of an organic fatty acid and N-halogen halogen compound as the photosensitive material has a high sensitivity.

EXAMPLE 13

A sample (F) was prepared in the same manner as in Example 11 except that 12.0 g of the dispersion (XXIII) prepared in Example 7 was used as the silver bromide dispersion. The results shown in Table 15 were obtained.

TABLE 15

| Sample | Silver halide dispersion | S | $\bar{r}$ | $D_{max}$ | $D_{min}$ |
|---|---|---|---|---|---|
| (F) | (XXIII) | 780 | 2.8 | 1.70 | 0.23 |

From the results shown in Table 15, it is understood that the heat-developable photosensitive material containing as the photosensitive material the photosensitive silver halide prepared from the C-halogen compound as the organic halogen compound has a high sensitivity, gradient and maximum density as well as a favorable low fog density.

EXAMPLE 14

A sample (G) was prepared in the same manner as in Example 11 except that 12.0 g of the dispersion (XXII) prepared in Example 6 was used as the silver halide dispersion. The results are shown in Table 16.

TABLE 16

| Sample | Silver halide dispersion | S | $\bar{r}$ | $D_{max}$ | $D_{min}$ |
|---|---|---|---|---|---|
| (G) | (XXII) | 700 | 3.2 | 1.70 | 0.21 |

From the results shown in Table 16, it is understood that the heat-developable photosensitive material can be obtained also when the photosensitive silver halide of the invention is silver iodobromide.

EXAMPLE 15

A sample (H) was prepared in the same manner as in Example 11 except that silver behenate was replaced with an equal molar amount of silver stearate and that 10.0 g of the dispersion (XVI) prepared in Example 5 was used as the silver halide dispersion. The results are shown in Table 17.

TABLE 17

| Sample | Silver halide dispersion | S | $\bar{r}$ | $D_{max}$ | $D_{min}$ |
|---|---|---|---|---|---|
| (H) | (XVI) | 650 | 3.0 | 1.76 | 0.30 |

From the results shown in Table 18, it is understood that the sample (H) of the present invention has a high sensitivity, gradient and maximum density.

EXAMPLE 16

50 ml of the dispersion (XV) prepared in Example 5 was added dropwise to 250 ml of water under vigorous stirring under irradiation with red safety light. A precipitate formed was filtered and dried to obtain 3.4 g of solid silver bromide/polyvinyl butyral. 3.0 g of the resulting solid silver bromide/polyvinyl butyral was dissolved again in ethyl alcohol. A half of the solution was maintained at 60° C. 1 ml of an aqueous solution of sodium thiosulfate ($4\times10^{-5}$ mol conc.) was added to the solution under stirring. The reaction was continued for additional one hour to obtain a sulfur-sensitized silver halide dispersion. A sample (I) was prepared using 10 g of the dispersion in the same manner as in Example 15. For comparison, a sample (J) was prepared using an equal quantity of the silver halide dispersion without the sulfur sensitization. The results are shown in Table 18.

TABLE 18

| Sample | S | $\bar{r}$ | $D_{max}$ | $D_{min}$ |
|---|---|---|---|---|
| (I) | 680 | 3.4 | 1.75 | 0.20 |
| (J) | 550 | 3.6 | 1.85 | 0.20 |

From the results shown in Table 19, it is understood that the photosensitive silver halide used for the preparation of the heat-developable photosensitive material of the present invention can be sensitized with sulfur.

EXAMPLE 17

Samples (K), (L), (M) and (N) were prepared in the same manner as in Example 11 and their characteristic curves were obtained. As the silver halide dispersions, the following silver bromide dispersions having particle sizes controlled with a particle size controlling agent were used in Samples (K), (L), (M) and (N):

K. 6.5 g of dispersion (XIII) prepared in Example 5

L. 6.5 g dispersion (XXXVII) prepared in Example 10,

M. 6.5 g of dispersion (XXXVIII) prepared in Example 10, and

N. 6.5 g of dispersion (XXXIX) prepared in Example 10.

The resulting characteristic curves are shown in the drawing. The drawing indicates that when the photosensitive silver halide of the present invention obtained with the particle size controlling agent is used, the heat-developable photosensitive material having desired photographic characteristics (sensitivity, maximum density and gradient) can be obtained easily.

What is claimed is:

1. A process for preparing a heat-developable photosensitive material including a step of forming a photosensitive layer on a base, wherein said photosensitive layer is made of a photosensitive composition comprising (a) an oxidation-reduction image forming component which comprises a reducible organic silver salt and a reducing agent, (b) a photosensitive silver halide, and (c) a binder, wherein the improvement comprises:

reacting (d) a silver salt of an organic fatty acid, said silver salt being dispersed or suspended in an organic liquid in which said silver salt (D) is insoluble or slightly soluble, with at least an equimolar amount of (e) an organic or inorganic halogen compound, to thereby completely convert said silver salt of an organic fatty acid (d) into said photosensitive silver halide (b); and the combining said silver halide (b) with said image-forming component (a) and said binder (c) to form said photosensitive composition for use in said photosensitive layer.

2. A process for preparing a heat-developable photosensitive material according to claim 1 said silver salt of an organic fatty acid (d) is a silver salt of an organic fatty acid having at least 5 carbon atoms.

3. A process for preparing a heat-developable photosensitive material according to claim 1, wherein the amount of said inorganic or organic halogen compound (e) is in the range of 1 to 3 mols per mol of the silver salt of an organic fatty acid (d).

4. A process for preparing a heat-developable photosensitive material according to claim 1 wherein said halogen compound (e) is an organic N-halogen compound.

5. A process for preparing a heat-developable photosensitive material according to claim 1 wherein said halogen compound (e) is an organic C-halogeno compound.

6. A process for preparing a heat-developable photosensitive material according to claim 1 wherein said halogen compound (e) is an onium halide.

7. A process for preparing a heat-developable photosensitive material according to claim 1 wherein at least 30 molar % of said inorganic or organic halogen compound (e) is a bromide.

8. A process for preparing a heat-developable photosensitive material according to claim 1 wherein the reaction of said silver salt of an organic fatty acid (d) with said inorganic or organic halogen compound (e) is carried out in the presence of a polyvinyl acetal resin.

9. A process for preparing a heat-developable photosensitive material according to claim 1 further comprising incorporating an organic fatty acid in said heat-developable photosensitive material.

10. A process for preparing a heat-developable photosensitive material according to claim 1 further comprising incorporating a toner in said heat-developable photosensitive material.

11. A process for preparing a heat-developable photosensitive material according to claim 4, wherein the photosensitive silver halide (b)-forming reaction is carried out in the presence of $1.0\times10^{-5}$ to $3.0\times10^{-1}$ mol, per mol of said organic N-halogen compound (e), of at least one silver halide particle size controlling agent selected from the group consisting of inorganic cation compounds excluding hydrogen and silver, organometallic compounds excluding silver compounds, organic chalcogenide compounds and molecular halogens.

12. A process for preparing a heat-developable photosensitive material according to claim 5, wherein the photosensitive silver halide (b)-forming reaction is carried out in the presence of $1.0\times10^{-5}$ to $3.0\times10^{-1}$ mol, per mol of said organic C-halogeno compound (e), of at least one silver halide particle size controlling agent selected from the group consisting of inorganic cation compounds excluding hydrogen and silver, organometallic compounds excluding silver compounds, organic chalcogenide compounds and molecular halogens.

13. A process as claimed in claim 1, further comprising chemically sensitizing said photosensitive silver halide (b).

14. A process as claimed in claim 1, wherein said organic fatty acid is selected from the group consisting of myristic acid, palmitic acid, stearic acid, arachidic acid, behenic acid and lignoceric acid.

15. A process as claimed in claim 1, wherein said halogen compound (e) is selected from the group consisting of organic halogen compounds of the formulas:

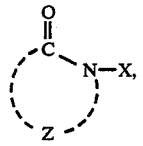
(I)

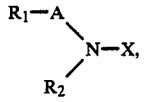
(II)

wherein X is a chlorine, bromine or iodine atom, Z is a group of non-metallic atoms which forms a 4 to 8 atom ring in the compound of formula (I), and $R_1$ and $R_2$ each represent hydrogen, unsubstituted or substituted alkyl, unsubstituted or substituted aryl, or alkoxy; and

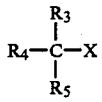
(III)

wherein $R_3$, $R_4$ and $R_5$ each represent hydrogen, unsubstituted or substituted alkyl, unsubstituted or substituted aryl, nitro, acyl, unsubstituted or substituted amido, sulfonyl, or sulfonyl substituted with an alkyl group or a halogen atom, with the proviso that at least one of $R_3$, $R_4$ and $R_5$ is nitro, unsubstituted or substituted aryl, alkenyl, aryl, amido or sulfonyl.

16. A process as claimed in claim 1, wherein said organic solvent is selected from alcohols, ketones, mixtures of ketones with other solvents, and mixtures of alcohols with other solvents.

17. A process as claimed in claim 1, further comprising forming a first mixture which is a dispersion or suspension containing 0.5 to 50 wt. % of said silver salt (d) in said organic liquid; forming a second mixture which is a dispersion or solution containing 0.5 to 50 wt. % of said halogen compound (e) in said organic liquid; and gradually adding said second mixture over a period in the range of 0.5 to 5 hours to said first mixture while stirring said first mixture and maintaining said first mixture at a temperature in the range of 20° C. to 100° C., thereby obtaining crystals of said photosensitive silver halide (b).

18. A process as claimed in claim 17, further comprising holding the reaction mixture resulting from the complete addition of said second mixture to said first mixture at said temperature for a period of 0.5 to 8 hours; an then cooling the reaction mixture to room temperature.

19. A process as claimed in claim 1, wherein said organic fatty acid has at least 16 carbon atoms and said photosensitive silver halide (b) contains at least 30 mol % of silver bromide.

20. A process as claimed in claim 1, wherein said organic liquid containing said silver salt (d) further contains 0.05 to 20 g, per gram of said silver salt (d), of an organic polymer effective to prevent irregular growth and aggregation of said photosensitive silver halide (b).

21. A process for preparing a heat-developable photosensitive material material including a step of forming a photosensitive layer on a base, wherein said photosensitive layer is made of a photosensitive composition comprising (a) an oxidation-reduction image forming a component which comprises a reducible organic silver salt and a reducing agent, (b) a photosensitive silver halide, and (c) a binder, wherein the improvement comprises:

forming a first mixture which consists essentially of (1) 0.5 to 50 wt. % of (d) a silver salt of a substituted or unsubstituted organic fatty acid having at least 5 carbon atoms, (2) 0.5 to 20 grams, per gram of said silver salt (d), of an organic polymer effective to prevent irregular growth and aggregation of said silver halide (b), and (3) the balance is essentially a first organic solvent selected from alcohols, ketones, and mixtures thereof with other solvents, said silver salt (d) being insoluble or sightly soluble in said first organic solvent, and said silver salt being dispersed or suspended in said first organic solvent;

forming a second mixture consisting essentially of an organic or inorganic halogen compound selected from the group consisting of hydrogen halides, metal halides, halogen-containing metal complexes, organic N-halogen compounds, organic C-halogeno compounds, and onium halides, and the balance is essentially a second organic solvent, said halogen compound being dispersed or dissolved in said second organic solvent, the amount of said halogen compound being in the range of 1 to 3 mols per mol of said silver salt;

then mixing together said first and second mixtures to form a reaction mixture;

then maintaining said reaction mixture under conditions effective to cause the formation of crystals of said silver halide (b) therein and completely convert said silver salt (d) into said silver halide (b); and then combining said silver halide (b) with said image-forming component (a) and said binder (c) to form said photosensitive composition for use in said photosensitive layer.

* * * * *

UNITED STATES PATENT AND TRADEMARK OFFICE

CERTIFICATE OF CORRECTION

PATENT NO. : 4 725 534

DATED : February 16, 1988

INVENTOR(S) : Kenji Kagami et al

It is certified that error appears in the above-identified patent and that said Letters Patent is hereby corrected as shown below:

Column 24, line 34; change "(D)" to ---(d)---.

line 40; change "the combining" to ---then combining---.

line 51; change "the silver" to ---said silver---.

Column 26, line 26; change "hours; an" to ---hours; and---.

line 39; delete "material" (second occurrence).

line 42; change "forming a" to ---forming---.

Signed and Sealed this

Ninth Day of August, 1988

*Attest:*

DONALD J. QUIGG

*Attesting Officer*

*Commissioner of Patents and Trademarks*